US006427649B1

(12) United States Patent
Cristiani et al.

(10) Patent No.: US 6,427,649 B1
(45) **Date of Patent: *Aug. 6, 2002**

(54) ELECTROMAGNETIC ACTUATOR OF AN IMPROVED TYPE FOR CONTROLLING THE VALVES OF AN INTERNAL-COMBUSTION ENGINE

(75) Inventors: Marcello Cristiani, Imola; Domenico Cannone; Massimo Marchioni, both of Bologna, all of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 09/666,336

(22) Filed: Sep. 21, 2000

(30) Foreign Application Priority Data

Sep. 30, 1999 (IT) ..... B099A0528

(51) Int. Cl.[7] ..... F01L 9/04; F01L 1/24

(52) U.S. Cl. ..... 123/90.11; 123/90.41; 123/90.46

(58) Field of Search ..... 123/90.11, 90.15, 123/90.39, 90.41, 90.45, 90.46, 90.61

(56) References Cited

U.S. PATENT DOCUMENTS 4,762,095 A * 8/1988 Mezger et al. ..... 123/90.11
5,161,494 A * 11/1992 Brown, Jr. ..... 123/90.11
5,762,035 A * 6/1998 Schebitz ..... 123/90.11
5,772,179 A * 6/1998 Morinigo et al. ..... 251/129.1
5,887,553 A * 3/1999 Ballmann et al. ..... 123/90.11

FOREIGN PATENT DOCUMENTS

DE 197 02 458 9/1997
DE 196 28 860 1/1998

* cited by examiner

*Primary Examiner*—Weilun Lo
(74) *Attorney, Agent, or Firm*—Arent Fox Kintner Plotkin & Kahn, PLLC

(57) ABSTRACT

Electromagnetic actuator of an improved type for controlling the valves for induction or exhaust of an internal-combustion engine, wherein an oscillating arm has a first end which is pivoted on a support frame which is secured to the head of the engine, and a second end which abuts the upper end of the stem of the valve for induction or exhaust; two electromagnets being provided to move the oscillating arm by command, such as to displace the said valve axially, between a position of closure and a position of maximum opening; the frame being pivoted on the head of the engine, such as being able to rotate around an axis of rotation, which is perpendicular to the axis of movement of the valve for induction or exhaust, and the electromagnetic actuator also being provided with a device to regulate the position of the frame relative to the head, which device can rotate the said frame by command around the said axis of rotation, such as to be able to maintain at a pre-determined value the mechanical play which exists between the second end of the oscillating arm, and the upper end of the stem of the valve.

8 Claims, 3 Drawing Sheets

ELECTROMAGNETIC ACTUATOR OF AN IMPROVED TYPE FOR CONTROLLING THE VALVES OF AN INTERNAL-COMBUSTION ENGINE

The present invention relates to an electromagnetic actuator of an improved type for controlling the valves of an internal-combustion engine.

BACKGROUND OF THE INVENTION

As is known, experiments are currently being carried out on internal-combustion engines, wherein the valves for induction and exhaust which put the combustion chamber of the engine selectively into communication respectively with the induction manifold and the exhaust manifold of the engine, are actuated by electromagnetic actuators, which are piloted by an electronic control system. This solution makes it possible to vary very accurately the lifting, opening time, and moments of opening and closure of the valves, according to the angular speed of the crankshaft and other operating parameters of the engine, thus increasing substantially the performance of the engine.

The electromagnetic actuator which provides the best performance at present is disposed adjacent to the stem of the valve to be moved axially, of the internal-combustion engine, and comprises:

- support frame which is integral with the head of the internal-combustion engine;
- an oscillating arm made of ferro-magnetic material, which has a first end pivoted on the support frame, such that it can oscillate around an axis of rotation which is perpendicular to the longitudinal axis of the valve, and a second end in the shape of a cam, which abuts the upper end of the stem of the valve; and
- a pair of electromagnets, which are disposed on opposite sides of the central portion of the oscillating arm, such as to be able to attract the oscillating arm by command and alternately, making it rotate around its axis of rotation.

Finally, the electromagnetic actuator comprises two resilient elements, which can keep firstly the valve of the engine in the position of closure, and secondly the oscillating arm in a position such as to keep the same valve in a position of maximum opening. These resilient elements act in opposition with one another, and have dimensions such that when both the electromagnets are not being supplied, i.e. when they are in a condition of equilibrium, the elements can position the oscillating arm in a position of rest, in which the latter is substantially equidistant from the polar heads of the two electromagnets, such as to keep the valve of the engine in an intermediate position between the position of closure and the position of maximum opening.

The main disadvantage of the above-described electromagnetic actuator is that it has mechanical play between the end in the shape of a cam of the oscillating arm, and the upper end of the stem of the valve, which varies substantially according to the temperature of use of the actuator, thus to some extend eliminating the advantages derived from the use of an electromagnetic actuator of this type. In fact, the lifting of the valve, the opening time, and the moments of opening and closure of the valves vary substantially according to the mechanical play which exists between the end in the shape of a cam of the oscillating arm, and the upper end of the stem of the valve, thus reducing substantially the accuracy of actuation which can be obtained by the said electromagnetic actuator.

SUMMARY OF THE INVENTION

The object of the present invention is to provide an electromagnetic actuator for controlling the valves of an internal-combustion engine, which is free from the above-described disadvantages.

According to the present invention, an electromagnetic actuator of an improved type is provided, for controlling the valves of an internal-combustion engine, comprising a head, at least one combustion chamber with a variable volume, at least one connection pipe which can put the said combustion chamber into communication with the exterior, and at least one valve which can regulate the passage of fluids from and towards the said combustion chamber; the said valve being fitted such as to be axially mobile in the head, between a position of closure in which it shuts the said connection pipe, and a position of maximum opening, in which it permits the passage of the fluids through the connection pipe, with the maximum flow rate permitted; the said electromagnetic actuator being fitted on the head, in order to move the said valve by command, between its position of closure and its position of maximum opening, and being characterised in that it comprises means for recovery of the mechanical play which exists between the said valve and the actuator itself.

BRIEF DESCRIPTION OF THE DRAWINGS

The present invention will now be described with reference to the attached drawings, which illustrate a non-limiting embodiment, in which.

DETAILED DESCRIPTION OF THE INVENTION

Figure 1:
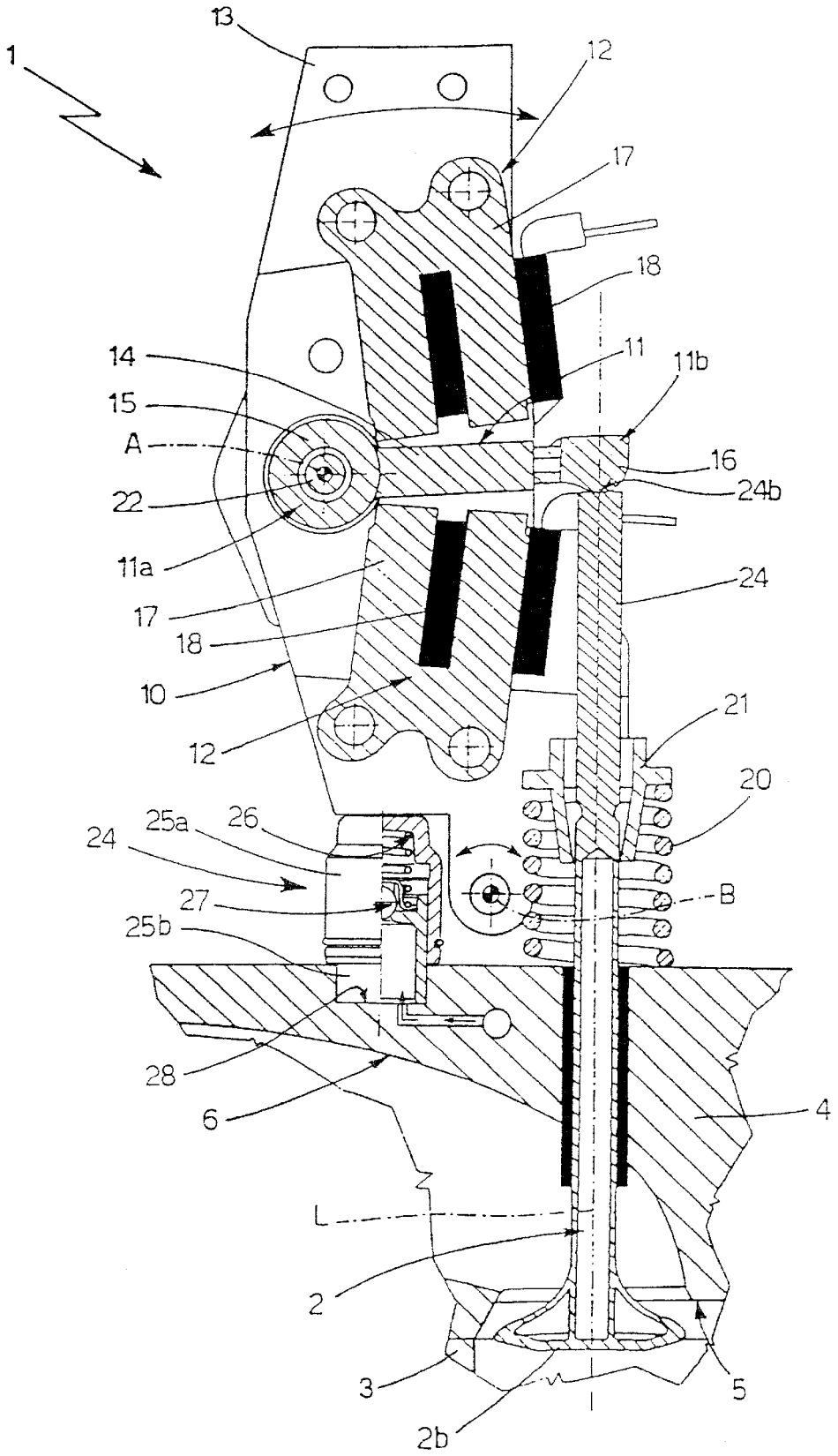
FIG. 1 is a front view, with parts in cross-section and parts removed for the sake of clarity, of an internal-combustion engine provided with an electromagnetic actuator for controlling the valves for induction and/or exhaust, produced according to the dictates of the present invention.
Figure 2:
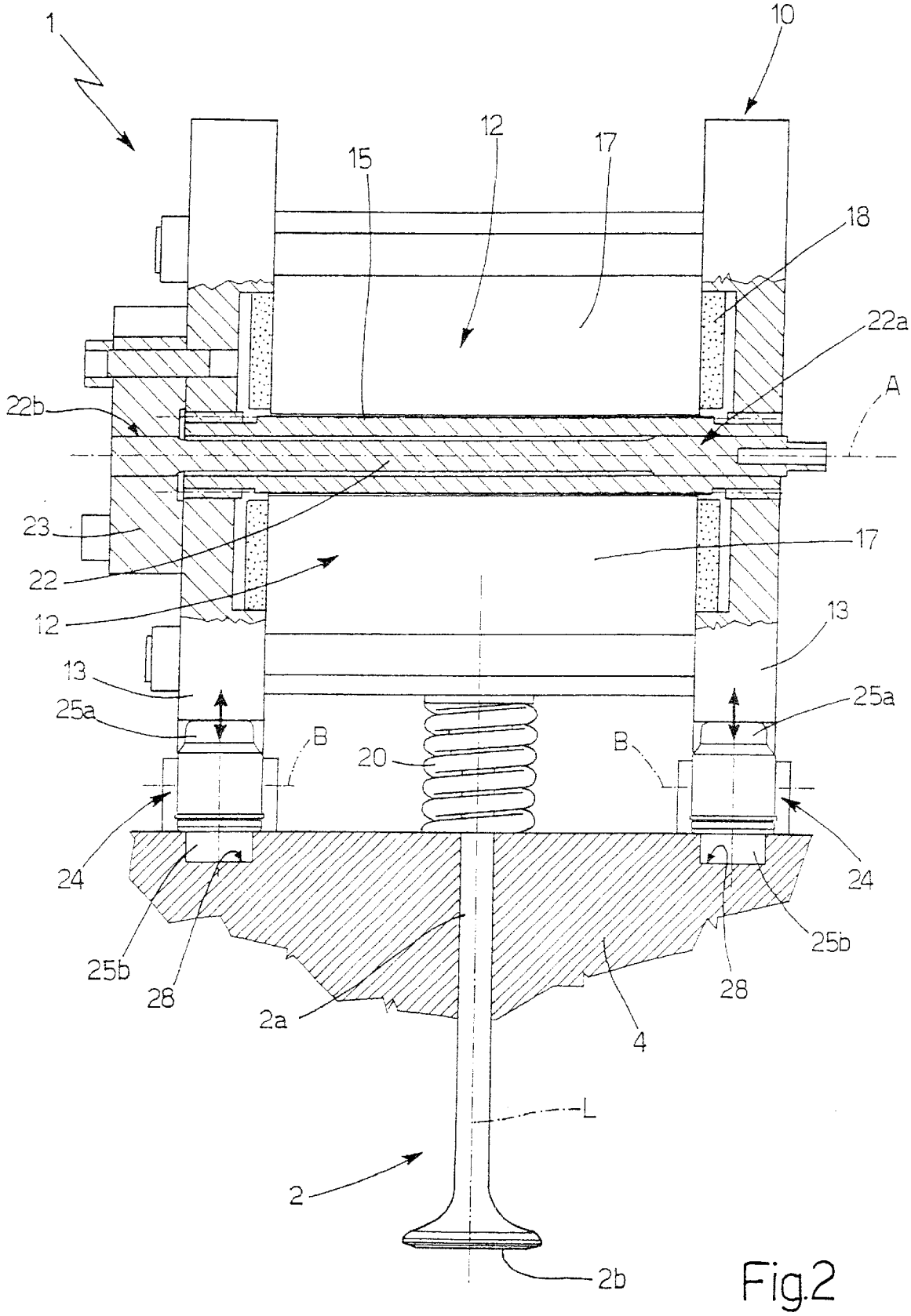
FIG. 2 is a rear view, with parts in cross-section and parts removed for the sake of clarity, of the electromagnetic actuator illustrated in FIG. 1.

With reference to FIGS. 1 and 2, the number 1 indicates as a whole an electromagnetic actuator which can displace by command at least one valve 2 for induction or exhaust of an internal-combustion engine, which normally comprises a base 3; one or more pistons (not illustrated), which are fitted such as to slide axially inside respective cylindrical cavities provided in the body of the base 3; and a head 4, which is disposed at the top of the base 3, to close the aforementioned cylindrical cavities.

Inside the respective cylindrical cavity, together with the head 4, each piston delimits a combustion chamber 5 with a variable volume, whereas for each combustion chamber 5, the head 4 is provided with at least one induction pipe and at least one exhaust pipe, which can connect the combustion chamber 5 respectively to the induction manifold and the exhaust manifold of the engine, both being of a known type, and not illustrated. Finally, with reference to FIG. 1, the internal-combustion engine is provided with a group of valves 2 of this type for induction and exhaust, which can regulate respectively the flow of air into the combustion chamber 5 via the induction pipe, and the discharge of burnt gases from the combustion chamber 5, via the exhaust pipe.

In this case, at the intake of each pipe, whether it is of the induction or exhaust type, the internal-combustion engine has a respective mushroom valve 2 of a known type, which is fitted on the head 4 of the engine, with its own stem 2*a* able to slide axially through the body of the head 6, and its own head 2*b* axially mobile at the intake of the pipe, such that it is mobile between a position of closure, in which the head 2*b* of the valve 2 prevents passage of the gases through the pipe for induction or exhaust, from and towards the combustion chamber 5, and a position of maximum opening, in which the head 2*b* of the valve 2 permits passage of the gases through the pipe for induction or discharge, from and towards the combustion chamber 5 itself, with the maximum flow rate possible.

In particular, FIG. 1 shows a portion of the head 4 at a combustion chamber 5, the final section of the induction pipe for this combustion chamber 5, and the induction valve 2, which can regulate the passage of the air through the said induction pipe, which is indicated hereinafter by the number 6.

With reference to FIGS. 1 and 2, the electromagnetic actuator 1 comprises a support frame 10, which is pivoted on the head 4 of the internal-combustion engine, as will be described in greater detail hereinafter; an oscillating arm 11 made of ferro-magnetic material, which has a first end 11*a* pivoted on the support frame 10, such that it can oscillate around an axis of rotation A which is perpendicular to the longitudinal axis L of the valve 2, and a second end 11*b*, which is disposed such as to abut directly the upper end of the stem 2*a* of the valve 2; and a pair of electromagnets 12, which are disposed one above the other, on opposite sides of the central portion of the oscillating arm 11, such as to be able to attract the oscillating arm 11 by command and alternately, making it rotate around the axis of rotation A.

In the example illustrated, the support frame 10 consists of a pair of plates 13, which are parallel and face one another, and extend adjacent to the stem 2*a* of the valve 2 to be moved axially, parallel to the longitudinal axis L of the valve 2, and are pivoted on the head 4 of the engine, such that they can oscillate around an axis of rotation B, which is preferably, but not necessarily, parallel to the axis of rotation A of the oscillating arm 11.

On the other hand, the oscillating arm 11 is disposed between the plates 13 which define the support frame 10, and consists of a central plate 14 made of ferro-magnetic material, which is positioned in the space which exists between the polar heads of the two electromagnets 12, of a cylindrical tubular element 15, which is integral with a lateral edge of the central plate 14, and finally, of a projection 16 which projects from the central plate 14, on the side opposite the cylindrical tubular element 15. With particular reference to FIGS. 1 and 2, the cylindrical tubular element 15 extends coaxially relative to the axis of rotation A, and is fitted such as to rotate on the plates 13 which define the support frame 10, by means of interposition of roller bearings of a known type, and defines the end 11*a* of the oscillating arm 11; whereas the projection 16 is in the shape of a cam, and is disposed such as to abut directly the upper end of the stem 2*a* of the valve 2, thus defining the end 11*b* of the oscillating arm 11 itself.

The two electromagnets 12 are both disposed between the plates 13 of the frame 10, and in the example illustrated, each of them comprises a magnetic core 17 in the shape of a U, which is secured to the support frame 10 such that its two polar ends face the central plate 14, and a coil 18 of electrically conductive material, which is fitted onto the magnetic core 17 itself.

It should be emphasised that, in order to reduce the losses of hysteresis, the magnetic core 17 consists of a set of small plates made of ferro-magnetic material, which are kept adhering to one another by clamping bolts, which are fitted such as to pass through the plates 13.

With reference to FIGS. 1 and 2, the electromagnetic actuator 1 additionally comprises two resilient elements, one of which can keep the valve 2 in the position of closure, and the other of which can keep the oscillating arm 11 abutting one of the two electromagnets 12, and in particular, the electromagnet 12 which the oscillating arm 11 must normally abut, in order to position the valve 2 in the position of maximum opening.

In this case, the first resilient element of the electromagnetic actuator 1, which is indicated hereinafter by the number 20, consists of a helical spring which is fitted onto the stem 2*a* of the valve 2, such as to have a first end which abuts the head 4 of the engine, and a second end which abuts a stop tang 21, which is secured to the stem 2*a* of the valve 2 itself. On the other hand, in the example illustrated, the second resilient element of the electromagnetic actuator 1, which is indicated hereinafter by the number 22, consists of a torsion bar, which is partially inserted inside the cylindrical tubular element 15, such as to have a first end 22*a*, which is angularly integral with the cylindrical tubular element 15, and a second end 22*b*, which is rendered integral with one of the plates 13 of the support frame 10, by means of a locking and adjustment element 23, which is present on the latter.

It should be emphasised that the two resilient elements, i.e. the helical spring 20 and the torsion bar 22, act in opposition to one another, and their resilient constants are selected such that, when both the electromagnets 12 are not being supplied, i.e. when they are in a condition of equilibrium, the elements position the oscillating arm 11 in a position of rest, in which the latter is substantially equidistant from the polar heads of the two electromagnets 12, such as to keep the valve 2 of the engine in an intermediate position between the position of closure and the position of maximum opening.

Finally, with reference to FIGS. 1 and 2, the electromagnetic actuator 1 comprises a device 24 for orientation of the frame, which can rotate by command the frame 10, i.e. the two plates 13, around the axis of rotation B, such as to be able to recover the mechanical play which exists between the end 11*b* of the oscillating arm 11, i.e. the projection 16 in the shape of a cam, and the upper end of the stem 2*a* of the valve 2.

In this case, the electromagnetic actuator 1 comprises one or more small hydraulic cylinders 24, which are actuated by pressurised oil, and can give rise to rotation of the frame 10 around the axis of rotation B, such as to vary the position of the electromagnetic actuator 1 relative to the head 4 and the valve 2, so as to keep at a pre-determined value the mechanical play which exists between the end 11*b* of the oscillating arm 11, i.e. the projection 16 in the shape of a cam, and the upper end of the stem 2*a* of the valve 2.

In the example illustrated in particular, the electromagnetic actuator 1 is provided with two small hydraulic cylinders 24, which are actuated by the pressurised oil which circulates in the lubrication circuit of the engine, each of which can vary the position of a respective plate 13 of the frame 10, relative to the head 4.

In fact, each small hydraulic cylinder 24 is disposed adjacent to the hinge which connects the corresponding plate 13 to the head 4, with a first end abutting the head 4 of the engine, and a second end abutting the lateral edge of the plate 13, such as to regulate the position of the plate 13, by varying its own axial length. In the example illustrated, each small hydraulic cylinder 24 in fact consists of two bowls 25*a* and 25*b* made of metal material, which are connected telescopically such as to define a chamber 26 with a variable volume, which can be filled with pressurised oil via a one-way valve 27, which is disposed on the base of the inner bowl 25*b*.

With reference to FIG. 1, the small hydraulic cylinders 24 are disposed on the head 4 of the engine, with the outer bowl 25*a* having its base abutting the plate 13, and with the inner bowl 25*b* accommodated overturned inside a seat 28, which is provided in the surface of the head 4. This seat 28 is connected to the lubrication circuit of the engine, such as to be filled by the pressurised oil which circulates in the said lubrication circuit.

When the pressure of the engine oil inside the seat 28 exceeds a pre-determined value, the one-way valve 27 on the base of the inner bowl 25*b* allows the pressurised oil to flow inside the chamber 26 which has a variable volume, thus giving rise to progressive expansion of the latter, and consequent spacing of the two bowls 25*a* and 25*b* from one another. On the other hand, the pressurised oil is discharged from the chamber 26 which has a variable volume, by means of blow-by at the connection between the two bowls 25*a* and 25*b*.

Figure 3:
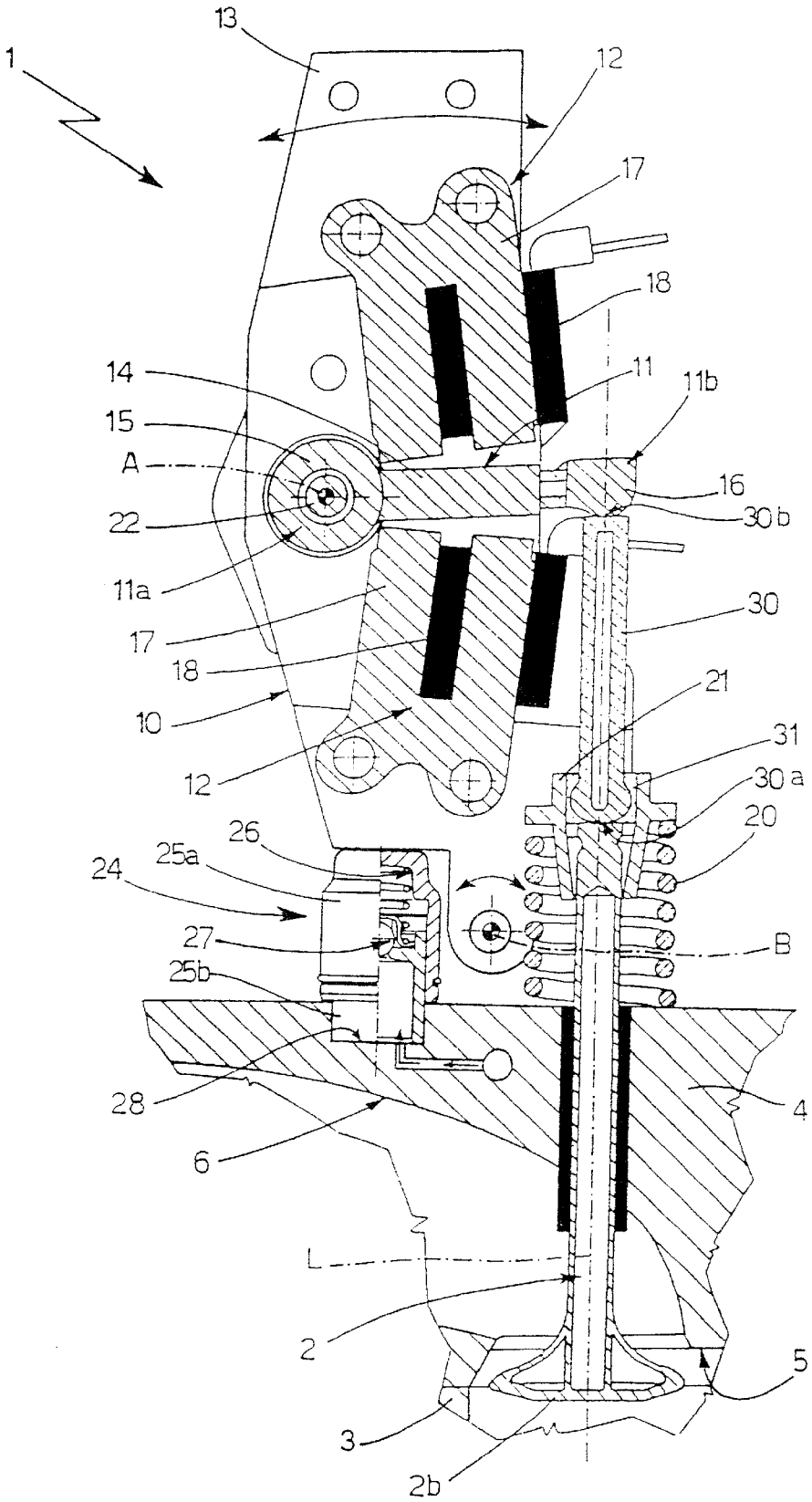
FIG. 3 is a variant of the electromagnetic actuator illustrated in FIG. 1.

According to the variant illustrated in FIG. 3, the end 11*b* of the oscillating arm 11, i.e. the projection 16 in the shape of a cam, is disposed such as to abut the upper end of the stem 2*a* of the valve 2, by means of interposition of a mechanical element which can minimise the flexural stresses to which the stem 2*a* of the valve 2 is subjected during functioning.

In this case, this mechanical element comprises a strut 30, which is interposed between the upper end of the stem 2*a* of the valve 2, and the end 11*b* of the oscillating arm 11, and a flexible coupling 31, which can keep the strut 30 itself integral with the stem 2*a* of the valve 2. The strut 30 consists of a rod 30, which has dimensions such as to withstand and transfer compression loads, extends coaxially relative to the stem 2*a* of the valve 2, and has a first end 30*a* which abuts the upper end of the stem 2*a* of the valve 2, and a second end 30*b*, which abuts the end 11*b* of the oscillating arm 11; whereas the flexible coupling 31 is positioned at the upper end of the stem 2*a* of the valve 2, and can keep the rod 30 coaxial relative to the stem 2*a* of the valve 2, with its end 30*a* always abutting the upper end of the stem 2*a* of the valve 2, nevertheless permitting minor oscillations of the rod 30 itself.

Since the strut 30 is connected to the stem 2*a* of the valve 2 by means of the flexible coupling 31, the mechanical stresses which are perpendicular to the stem 2*a* of the valve 2, and are produced by friction on the end 11*b* of the oscillating arm 11 at the end 30*b* of the strut 30, give rise only to oscillations of the strut 30, which are damped, and are not transmitted to the stem 2*a* of the valve 2.

It must be emphasised that, in the example illustrated, the end 30*a* of the strut has a hemi-spherical shape, such that it does not impede oscillations of the strut 30 on the upper end of the stem 2*a* of the valve 2. In addition, the rod 30 can be made in two pieces which are screwed to one another, so as to be able to regulate the axial length of the rod 30, in order to regulate the mechanical play.

According to a further variant, not shown, the electromagnetic actuator 1 does not have the helical spring 20, which can keep the valve 2 in the position of closure, the upper end of the stem 2*a* of the valve 2 is pivoted on the end 11*b* of the oscillating arm 11, and finally, the torsion bar 22 can keep the valve 2 in an intermediate position between the position of closure and the position of maximum opening.

The functioning of the electromagnetic actuator 1 can easily be understood from the foregoing description and illustration: when the two electromagnets 12 are supplied alternately, it is possible to move the valve 2 axially between the position of maximum opening, corresponding to when the oscillating arm 11 abuts the electromagnet 12, protected by the head 6, and the position of closure, which corresponds to when the oscillating arm 11 abuts the upper electromagnet 12. As far as the device 24 for orientation of the frame is concerned, i.e. the small hydraulic cylinders 24, conveying of oil at a pressure greater than that of calibration of the one-way valve 27 gives rise to rotation of the support frame 10 of the oscillating arm 11 around the axis of rotation B, such as to recover the mechanical play which exists between the end 11*b* of the oscillating arm 11, and the upper end of the stem 2*a* of the valve 2.

It should be specified that, in view of the extent of the mechanical play in question, the maximum rotation which is imparted by the small hydraulic cylinder(s) 24 to the frame 10 is normally less than 1 degree.

The advantages which are derived from use of the electromagnetic actuator 1 described and illustrated above are apparent: by means of the device 24 for orientation of the frame, it is now possible to recover the mechanical play which exists between the end 11*b* of the oscillating arm 11, and the upper end of the stem 2*a* of the valve 2, such as to maximise the performance of the electromagnetic actuators for control of the valves.

Finally, it is apparent that modifications and variants can be made to the electromagnetic actuator 1 described and illustrated here, without departing from the context of the present invention.

What is claimed is:

1. Electromagnetic actuator (1) for controlling valves (2) of an internal-combustion engine comprising a head (4), at least one combustion chamber (5) having a variable volume, at least one connection pipe (6) which puts the combustion chamber (5) in communication with an exterior, and at least one valve (2) that can regulate passage of fluids from and towards the combustion chamber (5), the valve (2) being fitted such as to be axially mobile in the head (4) between a position of closure in which the valve shuts the connection pipe (6), and a position of maximum opening in which the valve permits passage of the fluids through the connection pipe (6) with a maximum permissible flow rate; the electromagnetic actuator (1) being fitted on the head (4) in order to move the valve (2) by command between the valve position of closure and the valve position of maximum opening, the actuator comprising:

means for recovery of the mechanical play which exists between the valve (2) and the actuator (1);

a frame (10) pivoted on the head (4) of the engine, such that the actuator can rotate around a first axis of rotation (B), which is substantially perpendicular relative to the axis of movement (L) of the valve (2); wherein said means for recovery of the mechanical play comprises a device for regulation of the position of the frame (24) relative to the head (4), which can rotate said frame (10) by command around said first axis of rotation (B) to keep the mechanical play at a pre-determined value;

an oscillating arm (11) having a first end (11*a*) pivoted on said frame (10) such that the actuator can oscillate around a second axis of rotation (A), which is parallel to said first axis of rotation (B), and a second end (11 b) connected to the valve (2), and a pair of electromagnets (12), which can make said oscillating arm (11) rotate by command, in order to displace the valve (2) axially between the valve position of closure and the valve position of maximum opening;

a strut (30) interposed between said second end (11*b*) of the oscillating arm (11) and the valve (2) of the internal-combustion engine; and a flexible coupling (31), which keeps said strut (30) integral with the valve (2) of the internal-combustion engine.

2. Electromagnetic actuator according to claim 1, characterised in that the valve (2) of the internal-combustion is a mushroom valve fitted with a stem (2*a*) such that said mushroom valve slides axially through the head (6) of the internal-combustion engine, and said strut (30) is interposed between the second end 11*b* of the oscillating arm (11) and upper end of said stem (2*a*); said flexible coupling (31) keeps said strut (30) coaxial relative to the stem (2*a*) of the valve (2), with one end (30*a*) always abutting the upper end of the stem (2*a*).

3. Electromagnetic actuator according to claim 1, characterised in that said device for regulation of the position of the frame (24) relative to the head (4), comprises at least one small hydraulic cylinder (24) interposed between the frame (10) of the hydraulic actuator (1) and the head (4) of the internal-combustion engine.

4. Electromagnetic actuator according to claim 1, characterised in that said two electromagnets (12) are secured to the frame (10) on opposite sides of said oscillating arm (11).

5. Electromagnetic actuator according to claim 1, characterised in that the actuator comprises a first resilient element (20) that keeps the valve (2) in the position of closure; the second end 11*b* of said oscillating arm (11) abutting the valve (2) to transmit only axial thrust in opposition to that of said first resilient element (20).

6. Electromagnetic actuator according to claim 5, characterised in that the actuator comprises a second resilient element (22) that keeps the valve (2) in the position of maximum opening by exerting on the valve (2) axial thrust in opposition to that of said first resilient element (20).

7. Electromagnetic actuator according to claim 6, characterised in that, in a condition of equilibrium, said first (21) and said second (22) resilient elements keep the valve (2) in an intermediate position between said position of closure and said position of maximum opening.

8. Electromagnetic actuator according to claim 6, characterised in that said second resilient element (22) acts directly on said oscillating arm (11).

* * * * *